US011202957B2

(12) United States Patent
Kapsalis

(10) Patent No.: US 11,202,957 B2
(45) Date of Patent: Dec. 21, 2021

(54) RINK SAFETY SYSTEM AND PROCEDURE

(71) Applicant: Marc Kapsalis, Western Springs, IL (US)

(72) Inventor: Marc Kapsalis, Western Springs, IL (US)

( * ) Notice: Subject to any disclaimer, the term of this patent is extended or adjusted under 35 U.S.C. 154(b) by 0 days.

(21) Appl. No.: 16/826,698

(22) Filed: Mar. 23, 2020

(65) Prior Publication Data

US 2020/0215421 A1 Jul. 9, 2020

Related U.S. Application Data

(63) Continuation of application No. 16/403,933, filed on May 6, 2019, now Pat. No. 10,596,448, which is a continuation of application No. 15/731,918, filed on Jul. 17, 2017, now Pat. No. 10,279,244.

(60) Provisional application No. 62/494,542, filed on Aug. 12, 2016.

(51) Int. Cl.
*A63C 19/08* (2006.01)
*A63C 19/10* (2006.01)

(52) U.S. Cl.
CPC ..... *A63C 19/08* (2013.01); *A63C 19/10* (2013.01); *A63C 2019/085* (2013.01); *A63C 2203/20* (2013.01)

(58) Field of Classification Search
CPC ..... A63C 19/00; A63C 19/08; A63C 19/10; A63C 2019/085; A63B 71/022
USPC ..... 472/88–89, 92, 94; 256/1, 25, 26
See application file for complete search history.

(56) References Cited

U.S. PATENT DOCUMENTS

| | | | | |
|---|---|---|---|---|
| 805,500 | A * | 12/1905 | Wolfinger | |
| 7,914,385 | B2 * | 3/2011 | Palumbo | A63C 19/10 472/92 |
| 8,696,478 | B2 * | 4/2014 | Kapsalis | A63C 19/10 472/94 |
| 9,091,091 | B2 * | 7/2015 | Sicking | E04H 3/10 |
| 9,283,469 | B2 * | 3/2016 | Riley | E04H 17/14 |
| 2013/0040746 | A1 * | 2/2013 | Kapsalis | A63C 19/10 472/94 |

* cited by examiner

*Primary Examiner* — Kien T Nguyen
(74) *Attorney, Agent, or Firm* — McDonnell Boehnen Hulbert & Berghoff LLP

(57) ABSTRACT

A movable dasher board system optimizes user safety in a hockey rink or similar arena. A bottom structure, provided by a sliding bottom surface or roller assembly, has low friction characteristics, typically a $\mu_s$ of 0.05 or less with respect to ice if a sliding surface, or if roller bearings an effective coefficient of rolling friction 0.04 or less. A dasher board assembly is operatively connected to and extends upwardly from the bottom structure. Biasing and impact force absorbing devices (such as pneumatic or hydraulic or spring-encasing telescoping tubes, or foam, gel, or compression springs) bias the bottom structure and dasher board assembly to a desired position and absorb the impact of a human hitting the dasher board assembly to minimize the possibility of injury to the human. The system may be installed in a pre-existing rink or other arena.

12 Claims, 9 Drawing Sheets

RINK SAFETY SYSTEM AND PROCEDURE

CROSS REFERENCE TO RELATED APPLICATION

This application claims is a continuation of U.S. Non-Provisional application Ser. No. 16/403,933 entitled "Rink Safety System and Procedure", filed on May 6, 2019, which is a continuation of U.S. Non-Provisional application Ser. No. 15/731,918 entitled "Rink Safety System and Procedure", filed on Jul. 17, 2017, issued as U.S. Pat. No. 10,279,244, which claims priority to U.S. Provisional Application No. 62/494,542 entitled "Rink Safety System and Procedure", filed on Aug. 12, 2016, the contents of each of which are hereby incorporated by reference in their entirety.

BACKGROUND AND SUMMARY

Player and user safety is becoming much more important in hockey, and related sports and activities in ice rinks or the like. There have been many desirable proposals for accomplishing this, such as in U.S. Pat. Nos. 7,914,385, 8,696,478, 9,091,091, and 9,283,469, and Canadian 2708199. The invention seeks to take advantage of many of the desirable features of the above proposals, and to take a whole rink concept that will provide maximum protection to the players and users who might impact the side walls/dasher boards of the rink.

A significant feature of the invention is that it decouples the facing or moving portions of the walls/dasher boards from the heavy support structures. For example according to one aspect of the invention the dasher boards can actually move over the ice surface when impacted. According to another aspect, an off-the-ice support structure is provided so that only the facing moves upon impact. While in U.S. Pat. No. 9,091,091 an energy absorbing sports board assembly is provided that is not fixed to the floor of the arena but can move with respect to it, the structure provided includes a ramp and catch plate so that the relative movement of the board assembly is not actually on the surface of the arena and requires the movement of the entire heavy support structure. Also, the movement has a vertical component in addition to a horizontal one, which may be undesirable in some circumstances. These drawbacks are avoided according to the invention which provides a simple and effective system that utilizing almost exclusively horizontal movement and optimum safety for players and users.

According to another feature of the invention, roller or sliding elements are provided that can move in channels that allow a large deflection of dasher boards or the like around the periphery of a rink or other arena, perhaps even a deflection of as much as two feet.

According to one aspect of the invention a movable dasher board system is provided comprising: A bottom structure having low friction characteristics. A dasher board assembly operatively connected to and extending upwardly from the bottom structure. And biasing and impact force absorbing devices which bias the bottom structure and dasher board assembly to a desired position and upon movement of the bottom structure absorb the impact of a human hitting the dasher board assembly to minimize the possibility of injury to the human.

The bottom structure may comprise a bottom surface that is of any suitable material that itself has low friction characteristics, or the bottom surface may be coated with or operatively connected to a low friction material. For example the bottom surface may be a sliding surface (e.g. a plate or block) selected from the group consisting essentially of steel, acetal (e.g. Delrin®), and polytetrafluoroethylene (e. g. Teflon®), or a metal coated on the bottom thereof with polytetrafluoroethylene or acetal, or a metal structure operatively attached to a plate or sheet of acetal or polytetrafluoroethylene. For example many steels have a static coefficient of friction ($\mu_s$) with respect to ice of 0.03 while polytetrafluoroethylene has a $\mu_s$ with respect to itself of 0.04 and a $\mu_s$ of 0.02 with respect to ice that is dry, while acetal has a $\mu_s$ with respect to itself of 0.06 and an even lower $\mu_s$ with respect to ice [source: engineeringtoolbox.com; or "Friction Science and Technology" by Blau, Fundamentals of Sliding Friction, page 145]. Desirably the bottom surface has a $\mu_s$ of about 0.1 or less (preferably 0.05 or less, most preferably about 0.02-0.03) with respect to ice that is dry.

Typically, the bottom surface engages ice and the dasher board assembly slides with respect to the ice when impacted by a human, and under the bias of the bias and impact force absorbing devices. Alternatively the bottom surface may instead ride in a channel of metal or hard plastic, or may simply move on a sheet or plate or block of a material having low friction characteristics similar to the bottom surface.

Alternatively, the bottom structure low friction characteristics may be provided by a plurality of rollers, for example which provide an effective coefficient of rolling friction 0.04 or less (e.g. about 0.01). Suitable commercial rollers are available from SKF USA Inc. of Lansdale, Pa., Schaeffler Group of Herzogenaurach, Germany, and many other companies, and the basic concepts thereof are shown in U.S. Patent 808,500.

The dasher board assembly may comprise a typical dasher board, such as shown in a number of the above-mentioned patents, having a bottom portion of HDPE or the other materials listed in U.S. Pat. Nos. 8,696,478 and 7,914,385, and an upper transparent material portion such as acrylic or the other materials listed in U.S. Pat. Nos. 8,696,478 and 7,914,385.

The biasing and impact force absorbing devices may comprise a wide variety of mechanisms such as telescoping tubes (e. g. pneumatic or hydraulic pistons, or those with internal springs), foam, gel, compression springs, or the like. Normally the biasing and absorbing devices simply act between the bottom portions of the dasher board assemblies and a stationary exterior wall or the like, but they can also be provided at the upper portions of dasher board assemblies.

The system of the invention can either be installed indoors in a new arena, stadium, soccer facility, or other sport or activity area that has a history of injury from impacts on structures defining the playing/use surface. It may also be installed in any outdoor sports facility, with spectator and/or support areas exterior thereof, or it may be retrofit into existing facilities. When retrofit into existing facilities an ice rink may lose about 6-16 inches around the entire periphery in order to accommodate the new dasher board assemblies, bottom structures, and biasing and impact force absorbing devices. The embodiment of the invention which sits off the ice can be retrofit into just the ends or corners of the rink as this is where more than 75% of the severe and catastrophic injuries occur.

In situations where the rink or arena area is better suited to have a moving system outside of the ice surface then as long as some other low friction material is provided at the position to which a sliding bottom structure is normally biased, the desired features of the invention will still be accomplished. For example polytetrafluoroethylene has a $\mu_s$ with respect to itself of 0.04, while acetal has a $\mu_s$ with respect to itself of 0.06 so polytetrafluoroethylene or acetal bottom structures (such as plates) sliding on acetal or polytetrafluoroethylene floor areas will function nicely (e.g. a $\mu_s$ of about 0.1 or less). Alternatively the low friction features of the bottom structure may utilize roller bearings which move in a metal or plastic channel or on a surface, and the rollers may have an effective coefficient of rolling friction 0.04 or less.

According to another aspect of the present invention there is provided a movable dasher board system comprising: a mounting frame having upper and bottom structures having low friction characteristics; a dasher board assembly operatively connected to the mounting frame; and biasing and impact force absorbing devices which bias the mounting frame and dasher board assembly to a desired position and upon movement of the frame absorb the impact of a human hitting the dasher board assembly to minimize the possibility of injury to the human. The upper and bottom structures may comprise sets of rollers which provide an effective coefficient of rolling friction 0.04 or less, or alternatively may comprise sliding elements having a $\mu_s$ of about 0.1 or less on the surfaces on which they slide. The rollers or sliding elements may roll or slide in channels of metal or plastic. The bias and impact force absorbing devices are as described above, e.g. telescoping tubes.

According to a still another aspect of the invention there is provided a method of protecting human participant safety in a rink or arena by providing around the exterior of the playing or use surface of the rink or arena a movable dasher board system including a bottom structure having low friction characteristics, a dasher board assembly operatively connected to the bottom structure, and biasing and impact force absorbing devices which bias the bottom structure and dasher board assembly to a desired position and upon movement of the bottom structure absorb the impact of a human hitting the dasher board assembly to minimize the possibility of injury to the human.

It is the primary object of the present invention to provide an enhanced safety system, and method, for hockey rinks or other arenas or activities; this and other objects of the invention will become clear from a detailed description of the invention and from the appended claims.

DETAILED DESCRIPTION

Figure 1:
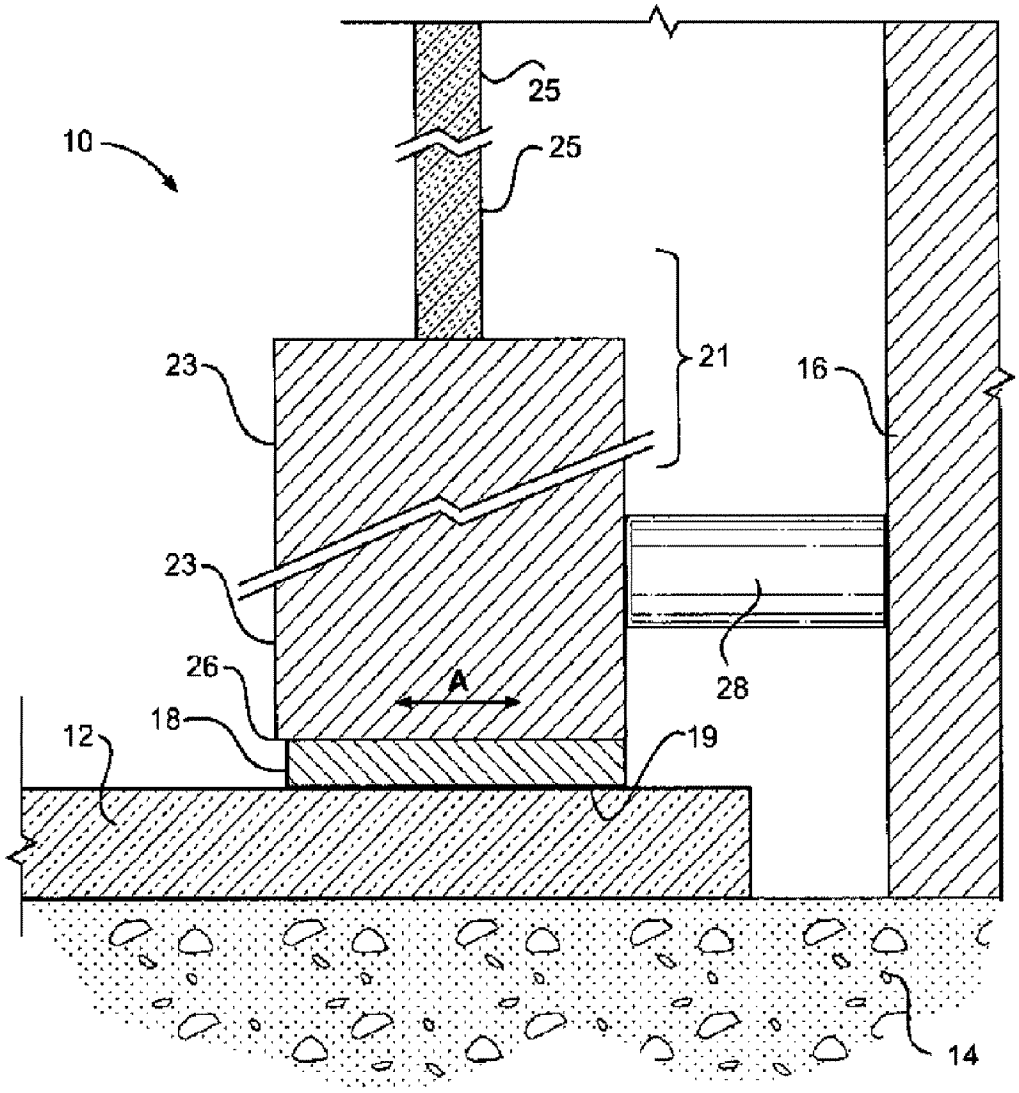
FIG. 1 is a side schematic view of an exemplary movable dasher board system according to the invention shown in association with ice and an exterior wall.
Figure 2:
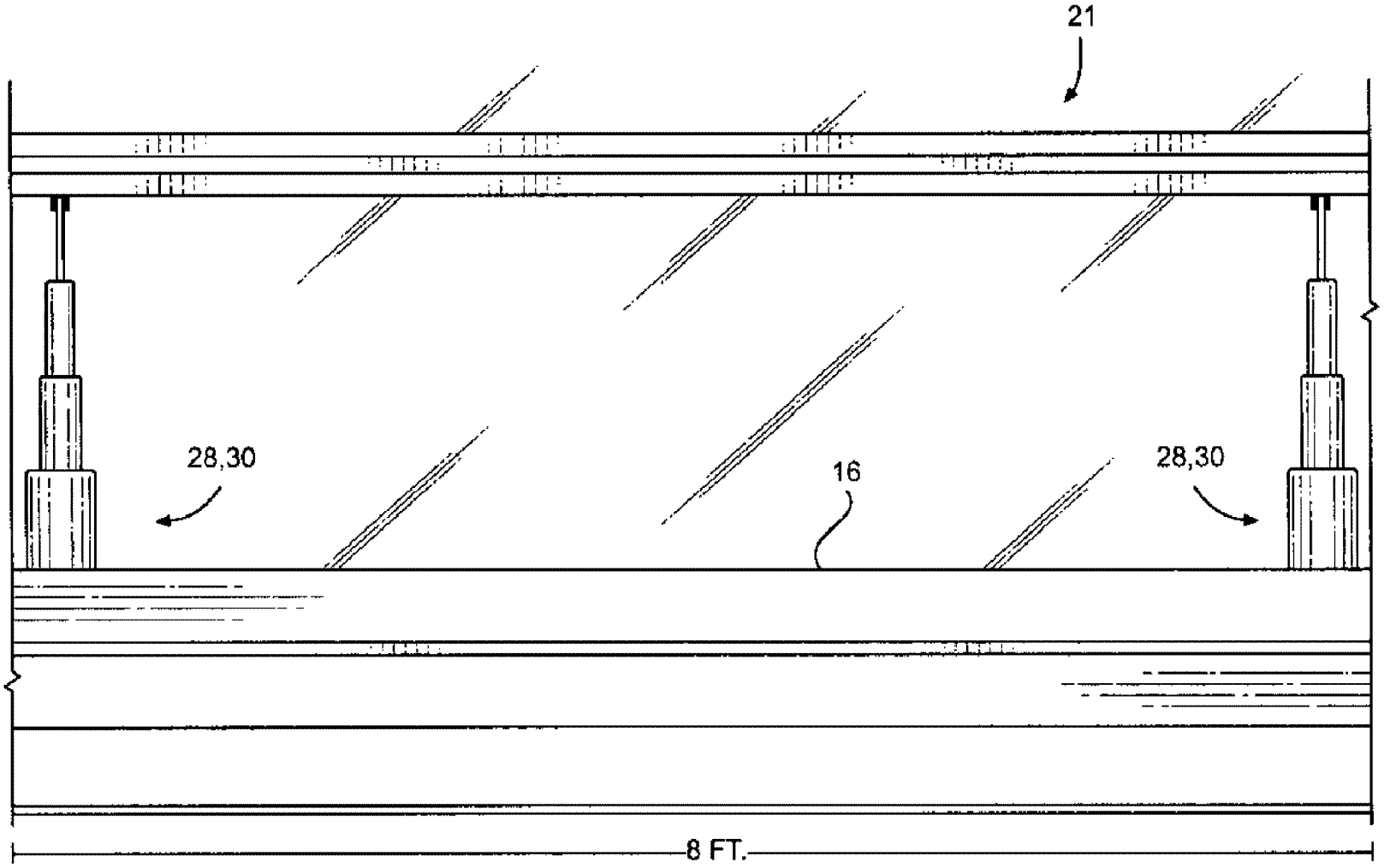
FIG. 2 is a top view similar to that of FIG. 1 and showing the biasing and impact force absorbing devices as telescoping pneumatic cylinders.

As seen in FIG. 1, an exemplary dasher board system according to the invention is shown generally by reference numeral 10. In this case the surface of the rink/arena floor which it associates with is a conventional layer of ice 12, which in turn is typically supported by a floor 14 of concrete or the like having cooling tubes therein. The rink/arena also has an exterior wall 16, behind which seating for spectators may be provided.

The system 10 as illustrated in FIG. 1 includes a bottom structure 18 (illustrated as a plate, but it may have other configurations) having a bottom surface 19 of low friction properties. The bottom structure 18 may be of any suitable material that itself has low friction characteristics, or the bottom surface 19 thereof may be coated or operatively connected to a low friction material. For example the structure 18 may be carbon steel, stainless steel, acetal (e.g. Delrin®), or polytetrafluoroethylene (e.g. Teflon®); or a metal (e.g. aluminum or steel) coated on the bottom 19 with polytetrafluoroethylene or acetal, or attached (e.g. by adhesive) to a plate or block of polytetrafluoroethylene or acetal. Desirably, the bottom surface 19 of the bottom structure 18 has a $\mu_s$ of about 0.1 or less with respect to ice that is dry, most desirably 0.05 or less (e.g. about 0.02-0.03).

The system 10 also comprises a dasher board assembly shown generally by reference numeral 21 operatively connected to and extending upwardly from the bottom structure 18. The dasher board assembly 21 may comprise a typical dasher board arrangement, such as shown in some of the above-mentioned patents, having a bottom portion 23 of HDPE or the other materials listed in U.S. Pat. Nos. 8,696,478 and 7,914,385, and an upper transparent material portion 25 of acrylic or the other materials listed in U.S. Pat. Nos. 8,696,478 and 7,914,385. The bottom portion 23 may be connected to the bottom structure 18 by mechanical fasteners, adhesive, and/or any other suitable conventional mechanisms. Note that the bottom interior lip 26 of the bottom portion 23 may interiorly slightly overlap the structure 18.

The system 10 further comprises biasing and impact force absorbing devices, shown schematically by reference numeral 28 in FIG. 1, which bias the bottom structure 18 and dasher board assembly 21 to a desired position (which position is seen in FIG. 1) and absorb the impact of a human hitting the dasher board assembly 21 to minimize the possibility of injury to the human. In response to a human impacting the dasher board assembly 21, the structure 18—and attached assembly 21—will move substantially completely horizontally over the ice 12 as illustrated by arrow A in FIG. 1. This movement against the bias of the devices 28 will absorb the force of the impact, yet the assembly 21 will be returned to the position illustrated in FIG. 1 once the impact force is removed.

Figure 4:
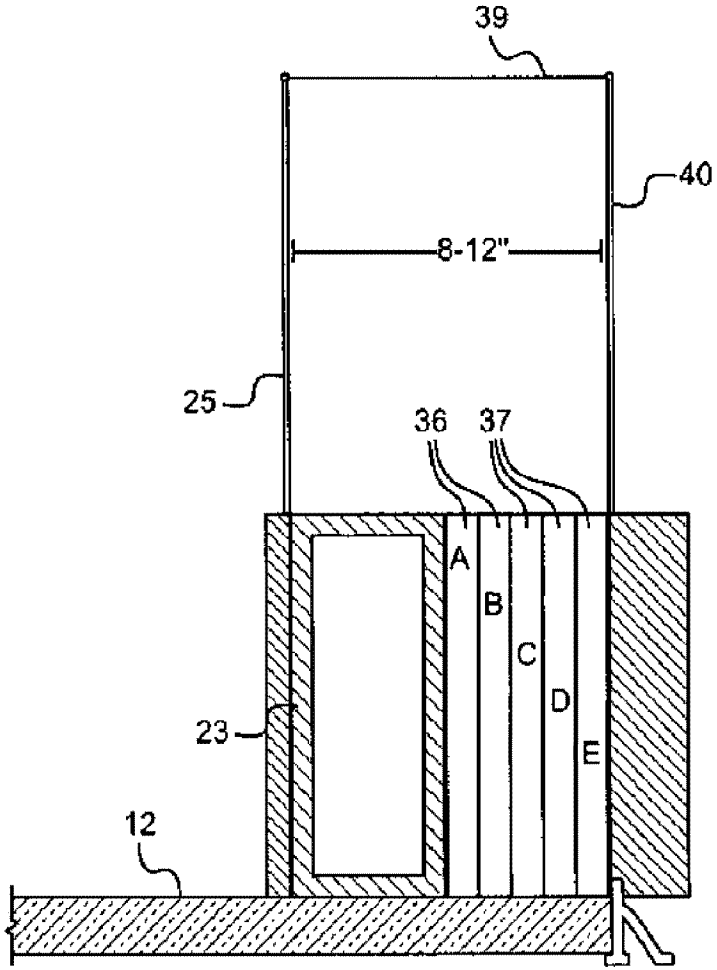
FIG. 4 is a schematic side view similar to that of FIG. 3 only showing the use of a number of force absorbing panels between the lower dasher board portion and the exterior wall.

The biasing and impact force absorbing devices 28 may comprise a wide variety of mechanisms such as pneumatic or hydraulic telescoping tubes, as illustrated at 28, 30 in FIGS. 2, 3, 5 and 6; or those with internal springs. Alternatively as shown schematically in FIG. 5, foam 28, 32, gel 28, 33, compression springs 28, 34, or the like may be utilized. FIG. 4 shows various panels 36, 37 of foam 28, 32, provided which deliver different amounts of force depending upon how many, and what type, of panels 36, 37 are provided. For example the panel designated A may absorb a force (of a human, puck, or other implement) of 1,000 Newtons (N) or less, B 3,000 N or less, C 5,000 N or less, D 10,000 N or less, and E 15,000 N or less.

Alternatively, the panels 37 may be crushable to absorb unusually intense impacts, and then replaced once crushed. In that case some other biasing devices would also be provided (such as pneumatic telescoping tubes 30).

Figure 3:
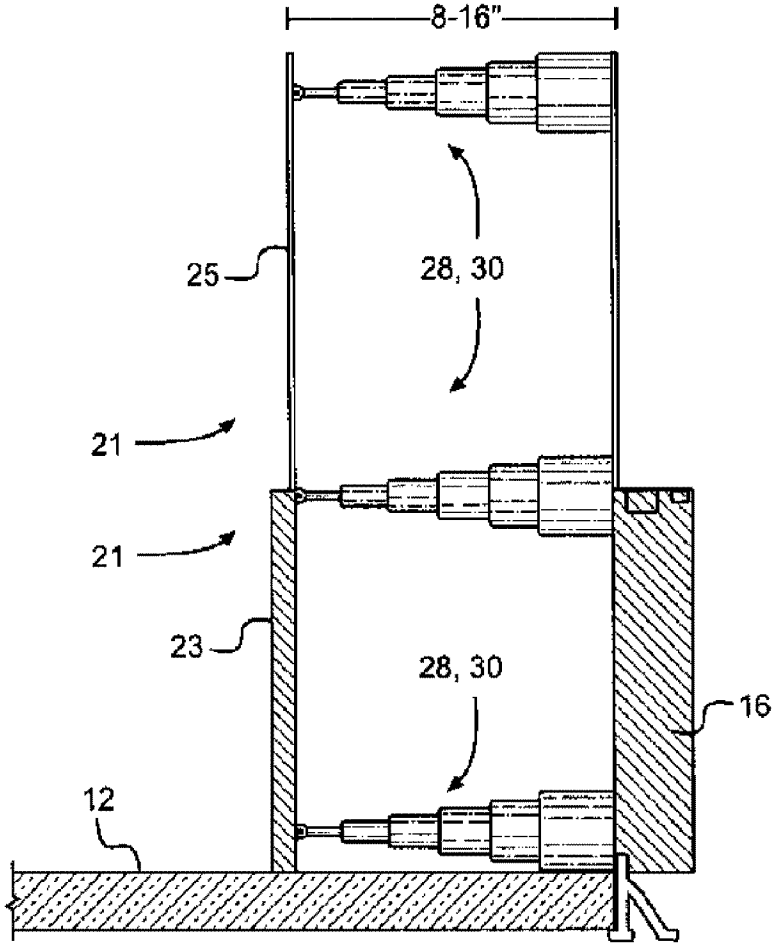
FIG. 3 is a schematic side view similar to that of FIG. 1 only not showing the bottom structure/plate in detail and showing the biasing and impact force absorbing devices as telescoping pneumatic cylinders.
Figure 5:
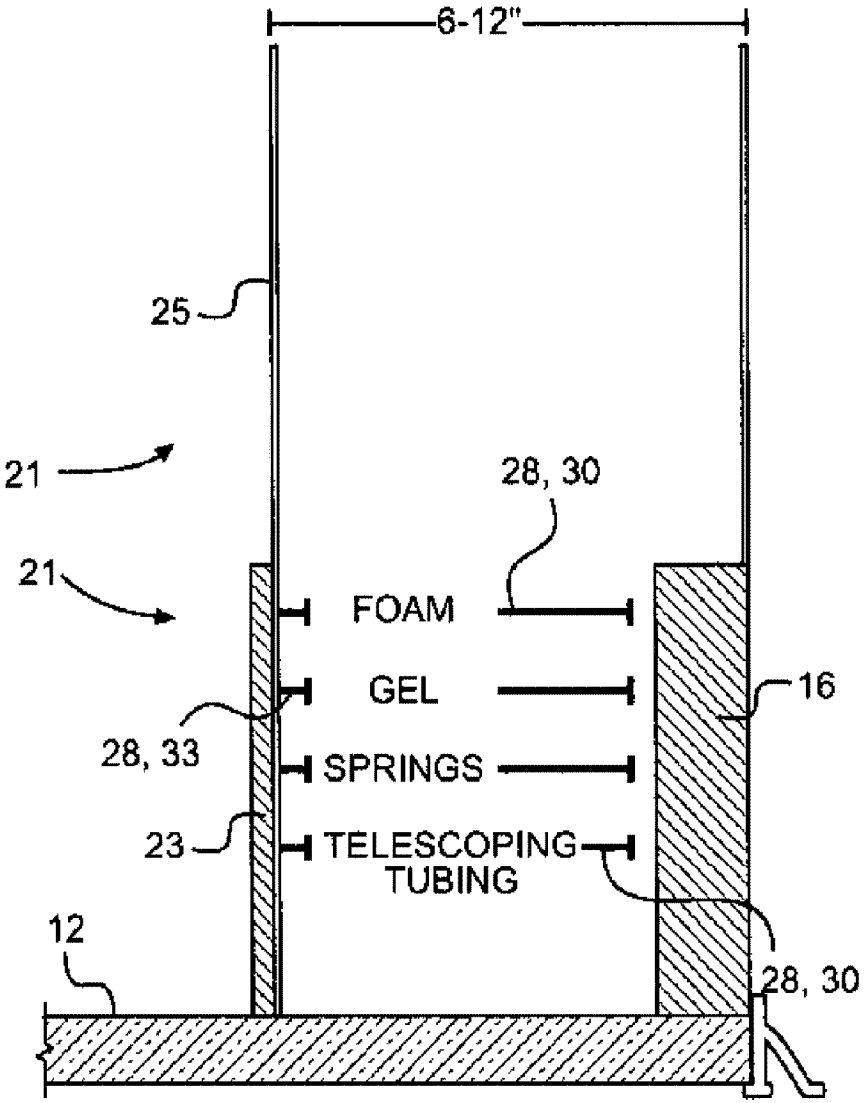
FIG. 5 is a view like that of FIG. 4 schematically showing other types of biasing and impact force absorbing devices that may be utilized.

Normally the biasing and absorbing devices 28 simply act between the bottom portions 23 of the dasher board assemblies 21 and a stationary exterior wall 16 or the like (as in FIG. 5), but they can also be provided at the upper portions 25 of dasher board assemblies 21 (FIG. 3). The exterior wall 16 may be a pre-existing conventional dasher board arrangement, as seen in FIGS. 3-5, and as seen in FIG. 4 a cable 39 may be provided at spaced locations between the upper portion 25 of the system according to the invention and the existing transparent portion 40 of the existing conventional dasher board arrangement.

Figure 6:
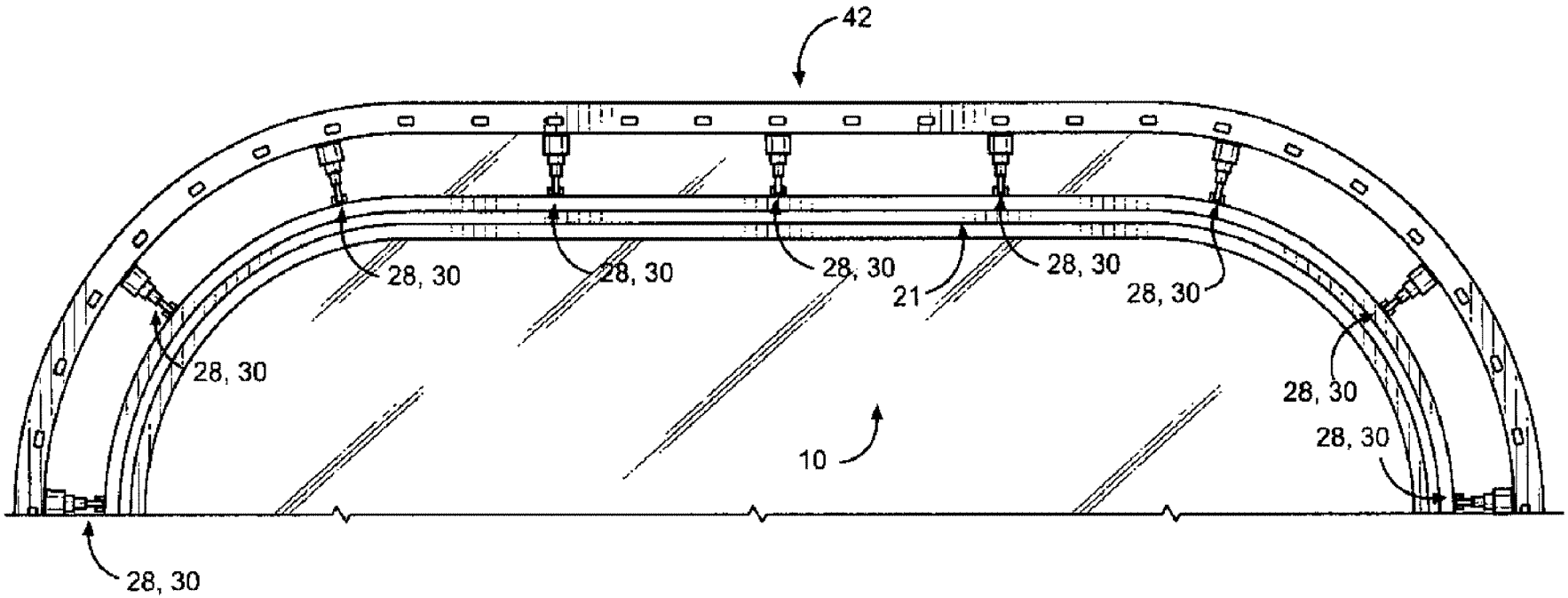
FIG. 6 is a top schematic view of an exemplary dasher board system according to the invention at one end of a rink.
Figure 7:
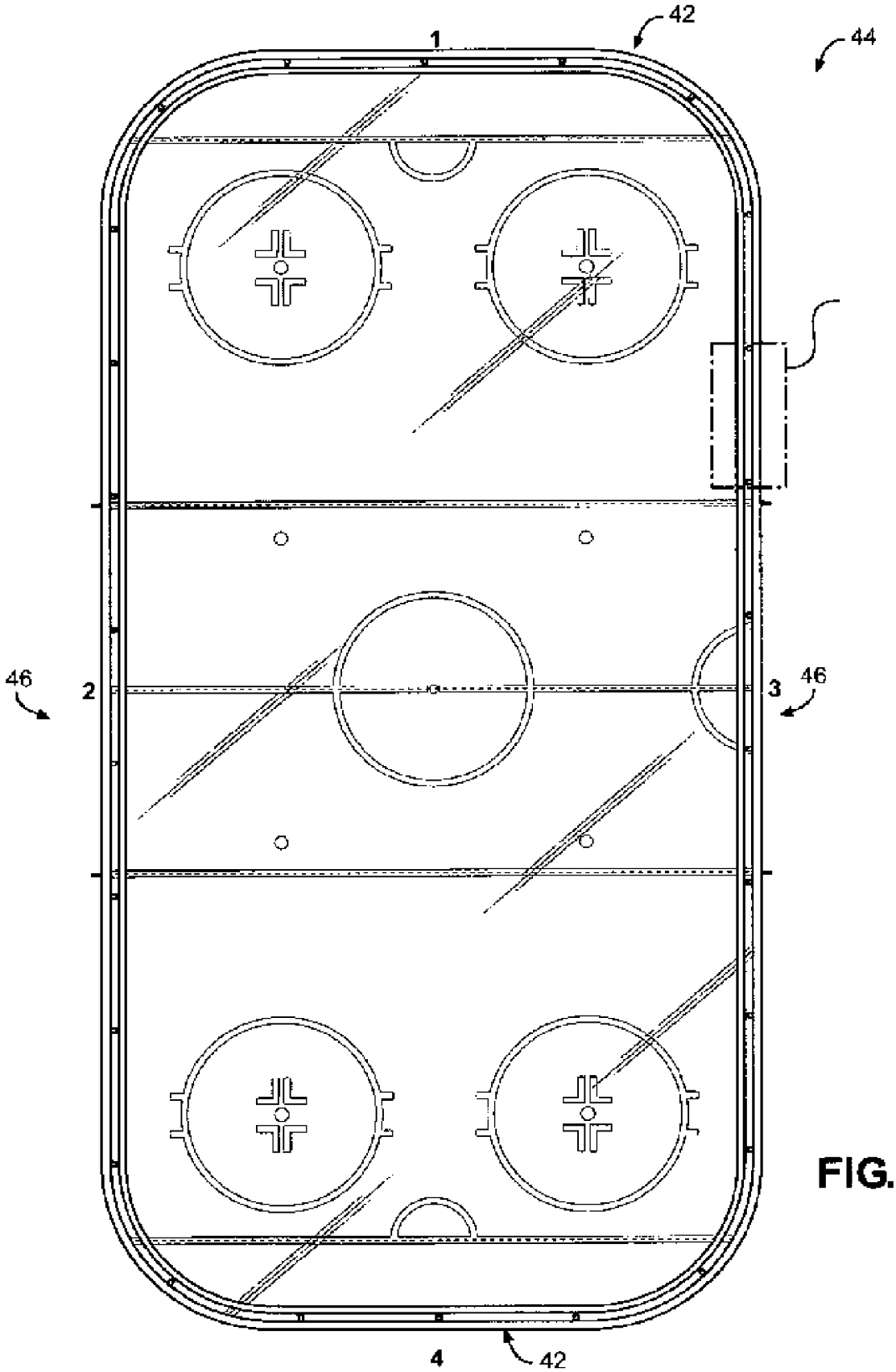
FIG. 7 is a top schematic view showing a completed rink utilizing two end sections and two side sections of dasher board systems according to the invention.

FIG. 6 schematically illustrates a system 10 according to the invention that provides an entire end 42 of a conventional hockey rink, such as the rink shown at 44 in FIG. 7. The rink 44 may be made up of two end sections 42 of systems 10 according to the invention, and two side sections 46 of systems according to the invention. The relative dimensions of the sections 42, 46 may be adjusted as desired, and instead of one piece each of the sections 42, 46 may be made up of multiple pieces. The invention also relates to a method of retrofitting an existing hockey rink utilizing the system 10.

While the invention is most desirable in association with ice 12, it may also be utilized with arenas or rinks having other floor surfaces. In such cases instead of ice 12 a sheet, panel, plate, or other surface of low friction material (such as steel, Delrin® or Teflon®) will be provided over the concrete surface 14 at the position to which the structure 18 is biased (as seen in FIG. 1) and will have sufficient dimensions so that the structure 18 may move substantially horizontally as indicated by arrow A to the full extent necessary to absorb the impact force of a human hitting the assembly 21.

In situations where no low friction material can be provided, but rather a simple conventional floor surface 16 (such as concrete) exists, then conventional roller bearings may be provided on the bottom surface 19 of structure 18, such as commercially available rollers from SKF USA Inc. of Lansdale, Pa., Schaeffler Group of Herzogenaurach, Germany, and many other companies, and the basic concepts of which are shown in U.S. Patent 808,500. The rollers themselves preferably provide an effective coefficient of rolling friction 0.04 or less, typically about 0.01.

Figure 8:
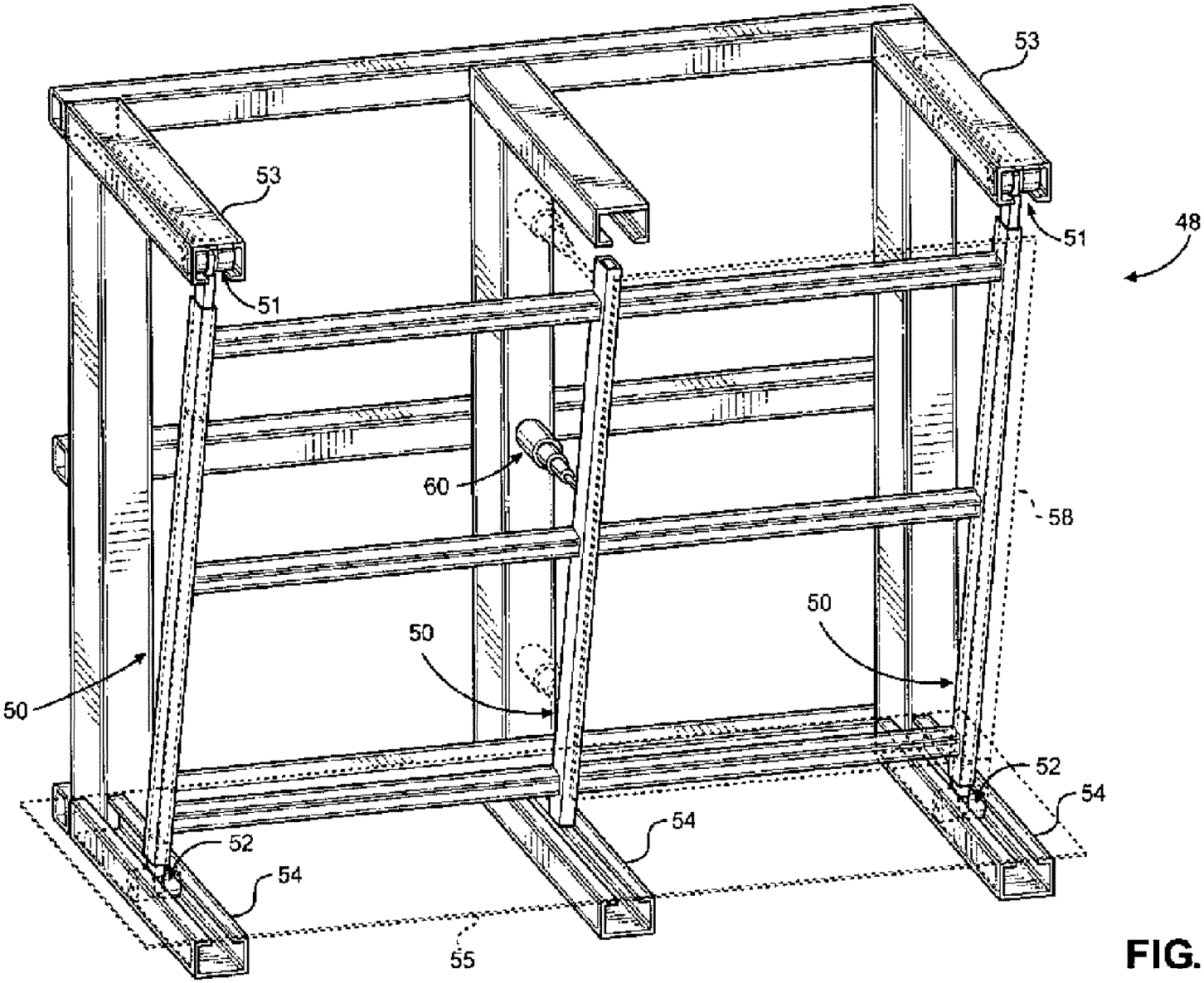
FIG. 8 is a schematic isometric view of a dasher board system using rollers to provide the low friction characteristics of the bottom structure, and which are ganged to another set of rollers vertically above the bottom structure.

FIGS. 8-11 show a more complex embodiment of the invention than illustrated in FIGS. 1-5 which sits off the ice of a hockey rink (or other playing surface of another type of sports facility). In this embodiment, as seen perhaps most clearly in FIG. 8, a movable dasher board system, shown generally by reference numeral 49, is provided which includes a mounting frame 50. The mounting frame 50 has upper 51 and bottom 52 structures with low friction characteristics. In FIG. 8 the structures 51, 52 comprise sets of rollers (such as described in the previous paragraph) which roll in metal or plastic upper and lower channels 53, 54, respectively. The lower channels 54 are at or below the level of the ice I or other playing/use surface of the rink or arena, and positioned so as to have minimum interference with the playing/use surface I. A metal or durable hard plastic plate 55 (shown only partially and in dotted line in FIG. 8) may be provided between the open slits in the channels 54, and a similar plate (not shown) for the channels 53.

The system 49 further includes a dasher board assembly, cut away and shown in dotted line at 58 in FIG. 8, comparable to the dasher board assembly 21 in the earlier embodiments. The dasher board assembly 58 is operatively connected to the mounting frame 50 by any suitable devices, such as mechanical fasteners, adhesive, welding, brackets, or the like.

Figure 9:
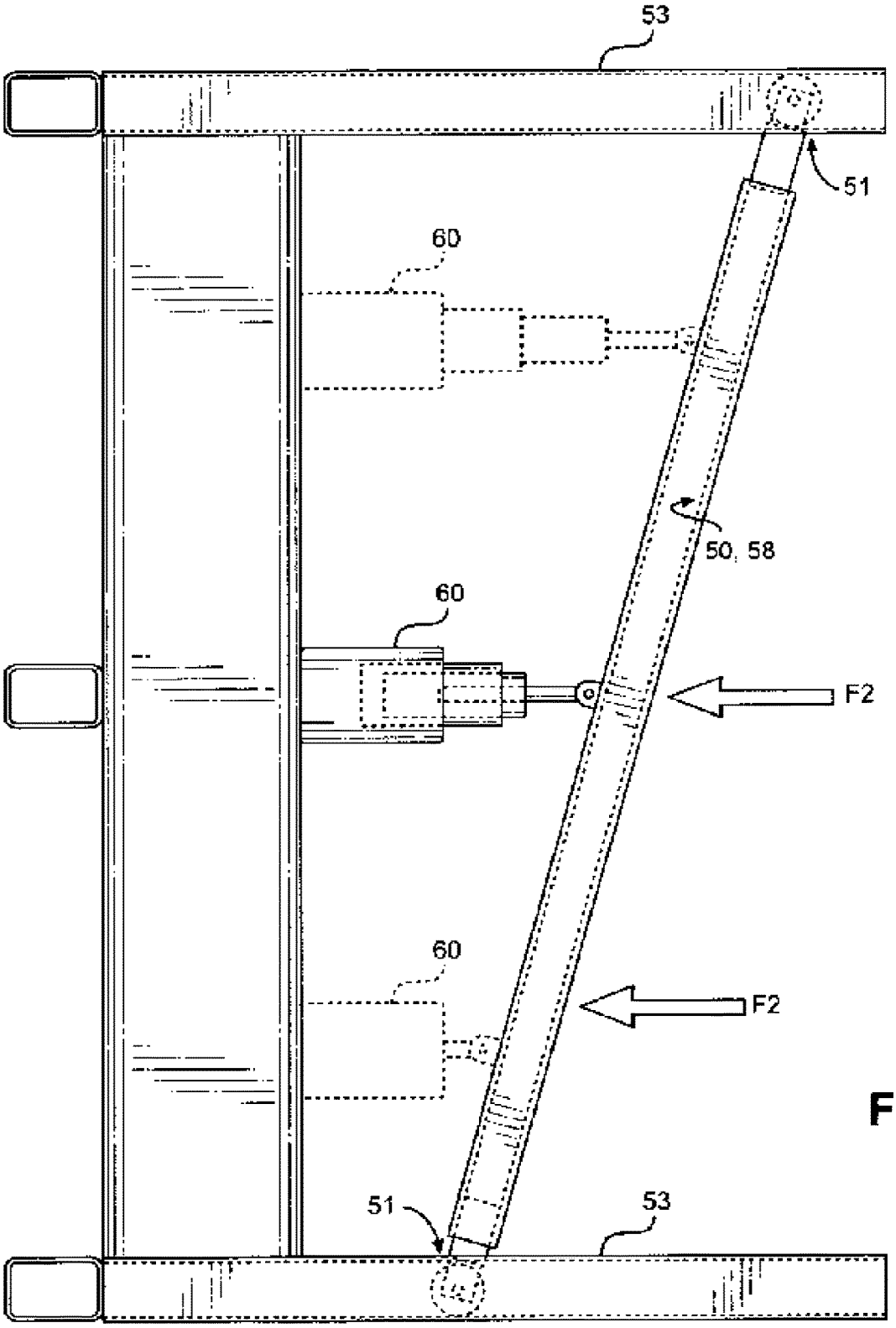
FIG. 9 is a schematic top view of the system of FIG. 8 showing deflection of the roller sets when an exemplary particular type of concentrated force is applied to the dasher boards.

The system 49 further includes biasing and impact force absorbing devices, shown schematically at 60 in FIGS. 8 & 9, which bias the mounting frame 50 and dasher board assembly 58 to a desired position and upon movement of the frame 50 absorb the impact of a human hitting the dasher board assembly 58 to minimize the possibility of injury to the human. The devices 60 may be any of the devices 28 in the earlier embodiments, although telescoping tubes (like 30) are preferred. Only one device 60 is illustrated in solid line in FIGS. 8 & 9, but as seen in FIG. 9 at 60' a plurality of such devices may be provided for each frame section 50.

FIG. 9 shows one form of operation of the system 49 when a localized force $F_2$ is applied to the structures 50, 58. As seen in this top view, the left portion of the structures 50, 58 move significantly to absorb the force $F_2$, while the right portion moves little or not at all. Of course if the force applied is not localized, but is near the center of the structures 50, 58, then both the right and left portions may move/deflect uniformly.

Figure 10:
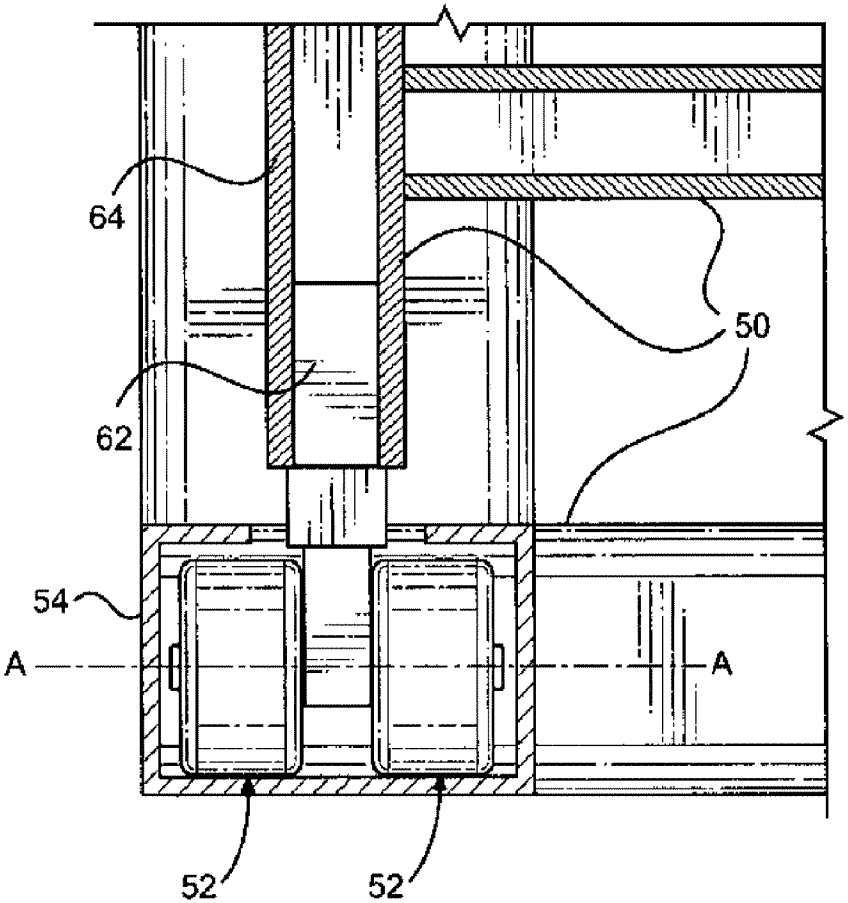
FIG. 10 is a detail end view of an exemplary embodiment of one set of rollers of the system of FIGS. 8 & 9.

FIG. 10 is a view showing a set of conventional rollers 52 in a bottom channel 54 in detail. Two conventional ball bearing rollers 52, preferably having an effective coefficient of rolling friction 0.04 or less (e.g. about 0.01), are mounted for rotation about a horizontal axis A-A to a central shaft 62, received in a sleeve 64, as is conventional.

Figure 11:
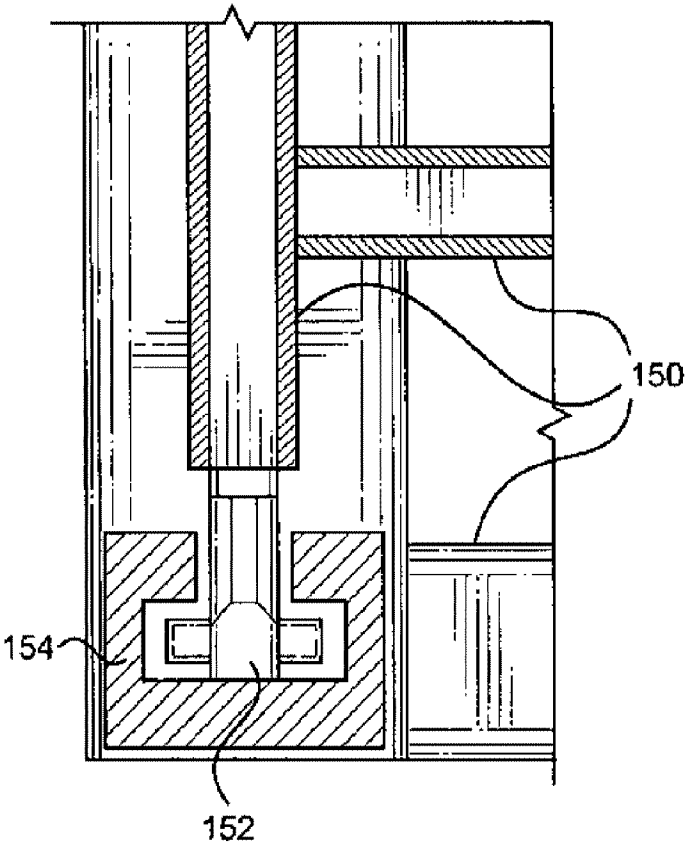
FIG. 11 is a view like that of FIG. 10 only showing a low friction sliding structure instead of rollers in the system of FIGS. 8 & 9.

FIG. 11 shows an alternative embodiment in which components comparable to those in the FIG. 10 embodiment are shown by the same reference numeral only preceded by a "1." In this case instead of rollers, the upper and bottom structures (only the bottom structure 152 shown in FIG. 11) comprise sliding elements having a $\mu_s$ of about 0.1 or less (preferably 0.05 or less, e.g. about 0.02-0.03) on the surfaces on which they slide. Again, channels, such as channel 154, may be provided, or the element 152 may simply slide on a sheet or strip. The element 152 is shown as a block of low friction material such as smooth steel, acetal, or polytetrafluoroethylene, although other configurations may be provided, and the surface of the channel 154 which the block 152 engages is also of low friction material.

It will be seen that a method according to the invention is readily practiced to retrofit existing rinks or arenas, or provided as new construction in rinks or arenas not yet in existence, by introducing the structures set forth in the above detailed description. This includes a method of protecting human participant safety in a rink or arena by providing around the exterior of the playing or use surface of the rink or arena a movable dasher board system 10, 49, including a bottom structure 18, 52, 152, having low friction characteristics, a dasher board assembly 21, 58, operatively connected to the bottom structure, and biasing and impact force absorbing devices 28, 60, which bias the bottom structure and dasher board assembly to a desired position (FIGS. 1 and 8) and upon movement of the bottom structure (see FIG. 9 for example) absorb the impact of a human hitting the dasher board assembly to minimize the possibility of injury to the human.

While the invention has been illustrated and described in preferred embodiments it is to be understood that the invention is to be interpreted as broadly as possible to encompass all equivalent assemblies, devices, structures, methods, and procedures, limited only by the prior art; all broad ranges include all specific ranges within the broad range.

I claim:

1. A movable dasher board system, comprising:

a bottom structure including a bottom surface coated with or operatively connected to a low friction material;

a dasher board assembly operatively connected to and extending upwardly from the bottom structure; and biasing and impact force absorbing devices coupled to the dasher board assembly, wherein the bottom surface engages ice and the dasher board assembly slides substantially only horizontally with respect to the ice when impacted by a human, and under the bias of the bias and impact force absorbing devices, and wherein the biasing and impact force absorbing devices bias the bottom structure and dasher board assembly to a desired position and upon movement of the bottom structure absorb an impact of a human hitting the dasher board assembly to minimize a possibility of injury to the human.

2. The movable dasher board system of claim 1, wherein the bottom surface is selected from the group consisting of steel, acetal, and polytetrafluoroethylene, or a metal coated on the bottom thereof with polytetrafluoroethylene or acetal, or operatively attached to a plate, block, or a sheet of polytetrafluoroethylene or acetal.

3. The movable dasher board system of claim 1, wherein the bottom surface has $\mu_s$ of about 0.1 or less with respect to ice that is dry.

4. The movable dasher board system of claim 1, wherein the bottom surface has a $\mu_s$ of 0.05 or less with respect to ice that is dry.

5. The movable dasher board system of claim 1, wherein the bias and impact force absorbing devices are selected from the group consisting of telescoping tubes, foam, gel, and compression springs.

6. The movable dasher board system of claim 1, wherein the bottom structure engages and slides on a surface selected from the group consisting essentially of steel, acetal, and polytetrafluoroethylene.

7. The movable dasher board system of claim 1, wherein the dasher board assembly includes a bottom portion and an upper transparent portion.

8. The movable dasher board system of claim 7, wherein the biasing and impact force absorbing devices are coupled to only the bottom portion of the dasher board assembly.

9. The movable dasher board system of claim 7, wherein the biasing and impact force absorbing devices are coupled to both the bottom portion and upper transparent portion of the dasher board assembly.

10. The movable dasher board system of claim 7, wherein a bottom interior lip of the bottom portion interiorly overlaps the bottom structure.

11. The movable dasher board system of claim 7, wherein a material of the bottom surface comprises a first material, and wherein a material of the bottom portion comprises a second material that is different than the first material.

12. A method of protecting human participant safety in a rink or arena by providing around an exterior of a playing or use surface of a rink or arena the movable dasher board system of claim 1.

* * * * *